US005545501A

United States Patent [19]

Tavernier et al.

[11] Patent Number: 5,545,501

[45] Date of Patent: Aug. 13, 1996

[54] ELECTROSTATOGRAPHIC DEVELOPER COMPOSITION

[75] Inventors: Serge Tavernier, Lint; Frank Ruttens, Overijse; André Verhecken, Mortsel; Jozef Mampaey, Kontich; Ludovicus Joly, Hove, all of Belgium

[73] Assignee: AGFA-Gevaert, N.V., Mortsel, Belgium

[21] Appl. No.: 347,346

[22] PCT Filed: Jun. 7, 1994

[86] PCT No.: PCT/EP94/01855

§ 371 Date: Dec. 6, 1994

§ 102(e) Date: Dec. 6, 1994

[87] PCT Pub. No.: WO95/00884

PCT Pub. Date: Jan. 5, 1995

[30] Foreign Application Priority Data

Jun. 22, 1993 [EP] European Pat. Off. ..... 93201795

[51] Int. Cl.[6] ..... G03G 9/107; G03G 9/08

[52] U.S. Cl. ..... 430/106.6; 430/108; 430/109; 430/110; 430/111

[58] Field of Search ..... 430/108, 111, 430/106.6, 109, 110

[56] References Cited

U.S. PATENT DOCUMENTS

| | | | |
|---|---|---|---|
| 4.996,126 | 2/1991 | Anno et al. | 430/108 |
| 5,190,841 | 3/1993 | Saha et al. | 430/106.6 |
| 5,225,302 | 7/1993 | Isoda et al. | 430/106.6 |

FOREIGN PATENT DOCUMENTS

| | | | |
|---|---|---|---|
| 0004748 | 10/1979 | European Pat. Off. . | |
| 0330498 | 8/1989 | European Pat. Off. | 430/111 |
| 223452 | 12/1984 | Japan . | |
| 3064764 | 3/1991 | Japan | 430/109 |
| 92/18908 | 10/1992 | WIPO . | |

*Primary Examiner*—Lee C. Wright
*Attorney, Agent, or Firm*—Breiner & Breiner

[57] ABSTRACT

This invention provides an electrostatographic developer composition comprising carrier particles and toner particles with a toner particle size distribution having a volume average particle size (T) such that 4 mμ≦T≦12 μm and an average charge (absolute value) pro diameter in femtocoulomb/10 μm ($C_T$) after triboelectric contact with said carrier particles such that 1 fC/10 μm≦$C_T$≦10 fc/10 μm characterised in that (i) said carrier particles have a saturation magnetization value, $M_{sat}$, expressed in Tesla (T) such that $M_{sat}$≧0.30 T (ii) said carrier particles have a volume average particle size ($C_{avg}$) such that 30 μm≦$C_{avg}$≦60 μm (iii) said volume based particle size distribution of said carrier particles has at least 90% of the particles having a particle diameter C such that 0.5 $C_{avg}$≦C≦2$C_{avg}$ (iv) said volume based particles size distribution of said carrier particles comprises less than b % particles smaller than 25 μm wherein b=0.35×($M_{sat}$)$^2$×P with $M_{sat}$: saturation magnetization value, $M_{sat}$, expressed in T P: the maximal field strength of the magnetic developing pole expressed in kA/m (v) said carrier particles comprise a core particle coated with a resin coating in an amount (RC) such that 0.2% w/w≦RC≦2% w/w.

13 Claims, 1 Drawing Sheet

ELECTROSTATOGRAPHIC DEVELOPER COMPOSITION

FIELD OF THE INVENTION

This invention relates to developer materials for use in electrostatographic imaging systems. More specifically this invention relates to a two component, dry electrostatographic developer composition comprising electrostatographic toner particles and carrier particles.

BACKGROUND OF THE INVENTION.

It is well known in the art of electrographic printing and electrophotographic copying to form an electrostatic latent image corresponding to either the original to be copied, or corresponding to digitized data describing an electronically available image.

In electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. from electron beam or ionized gas onto a dielectric substrate.

The obtained latent images are developed, i.e. converted into visible images by selectively depositing thereon light absorbing particles, called toner particles, which usually are triboelectrically charged.

In toner development of latent electrostatic images two techniques have been applied: "dry" powder and "liquid" dispersion development of which dry powder development is nowadays most frequently used.

in dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, April 1972, pp.495–511.

In most cases the latent image is developed with a finely divided developing material or toner to form a powder image which is then transferred onto a support sheet such as paper.

The transferred image may subsequently be permanently affixed to the substrate by heat, pressure, or a combination of heat and pressure.

Electrophotographic processes can not only be employed to form monochrome (black) images, but also to form colour images. It is known to form full colour images by sequentially forming and developing electrostatic colour sparation images with cyan, magenta, yellow and black toners respectively. In such applications high quality toners are needed.

By 'quality' in electrostatography is generally understood a true, faithful reproduction of the original to be copied, or faithful visual print of the electronically (digitally) available image.

Quality comprises features such as uniform darkness of the image areas, background quality, clear delineation of lines, good resolution of the image and particularly for colour images correct hue, high saturation and high lightness.

Recently the need for reproducing, with offset quality, not only line originals but also halftone originals or a combination of both by electrostatographic processes has steadily been rising. This means that the electrostatographic process must be able to reproduce faitfully both fine lines (i.e. have high resolution) and uniform density areas with low as well as high density and this with fairly low differences in density (i.e. having a good and stable gray scale balance).

It is known that to achieve high resolution imagiges by an electrostatographic system using one of the important contributing characteristics of high quality electrostatographic developers is the size and size distribution of the toner particles used as developing particles in case of a single component developer, and in case a two component developer material is used, in particular the size and size distribution of the toner particles employed. In the document published by ATR Corporation, 6256 Pleasant Valley Road, El Dorado, Calif. 95623, entitled 'Effect of Toner Shape on Image Quality' published Mar. 28, 1988, the influence of toner particle diameter and shape upon image quality, particularly for high resolution images, has been tested. Examples of toners comprising small particles with a narrow size distribution are disclosed in e.g. U.S. Pat. Nos. 4,748,474; 4,737,433; 4,434,220; 4,822,60 and WO A1 91/00548.

To improve further the quality of the developer, toner particles with volume average grain size lower than 4 to 5 μm and showing a narrow size distribution should be used. Although there are many processes to produce toner particles (e.g. by melt kneading all ingredients), few produce such toner particles having a narrow size distribution. If the production process itself does not yield a narrow size distribution, the toner particles have to be sized through classification. The efficiency of this classification process is strongly determined by particle size. The smaller the particle size the less efficient the classification process. Toner particles with an average size of less than 5 μm and narrow distribution are difficult to obtain. Such fine toner particles present a high production cost.

It is known that to produce a developer capable of yielding high electostatographic quality it is necessary to match the grain size of the carrier particles to the grain size of the toner particles. Examples of this reasoning can be found in e.g. U.S. Pat. No. 3,942,979 and EP 004748. Both these documents disclose that once the particle size of carrier and toner particles are matched any carrier, coated or uncoated can be used.

The importance of adapting the properties of toner particles and carrier particles such that both are matched, has been disclosed in DE-OS 3,549,358. A possible way to adapt the properties of the carrier particles to the properties of the toner partilces is to coat the former with a resin so as to maximize the overall developer performance of the carrier/toner combination.

The use of a polytetrafluorethylene (PTFE) coating on carrier particles that are used in combination with toner particles with small particle size is known to be beneficial. In U.S. Pat. No. 4,434,220 however it is disclosed that the PTFE coating is too sensitive to abrasion, giving toner contamination by fluorocarbons and hence an appreciable shift in properties of the toner particles. In U.S. Pat. No. 4,434,220 it is disclosed that this problem can be prevented by coating the carrier particles with a complex ternairy coating of polytetrafluoroethylene, fluorinated ethylene-propylene and poly(amide-imide).

Another way to further improve the quality of an electrostatographic developer is to lower the particles size of the carrier particles used in a two component developer as disclosed e.g. in EP 004748. However, the mere reduction of the size of all carrier particles, without special precautions, introduces problems. The magnetic attraction of smaller carrier particles is largely reduced, which gives an appreciable increase in the risk of carrier loss. By merely reducing the size of all carrier particles, the number of carrier particles, present in the developer composition is increased. This means that also between the magnetic roller surface and the latent image bearing member more carrier particles, surrounded by insulating toner particles, are present; this increases the electrical resistivity of the magnetic brush, reduces the field effect and enhances the edge effect, which is totally unwanted in high quality images. It is possible to overcome said problem of edge effects, by increasing the conductivity of the carrier particles, but it is not possible to vary the conductivity of the carrier particles within broad limits, since an increase in conductivity of the carrier particles gives also an increase of the risk of charge injection phenomena in the carrier particle, due to the electric field of the development, which again increases the risk of carrier loss.

The use of fine toner particles in itself and especially in combination with fine carrier particles, poses additional problems. The smaller the toner particles, the higher the electrostatic charge aquired by the toner particles during the triboelectric contact between toner and carrier particles. Since electrostatographic development can be looked upon as a (partial) charge neutralization of the electrostatic latent image on the latent image bearing member by oppositely charged toner particles, the electrostatic charge of the latent image is neutralized by a small number of toner particles when using highly charged toner particles. This results in low maximal optical densities in the image. To overcome this problem, it is necessary to use a higher development field (i.e. keeping the latent image bearing member on a higher electric potential), which again increases the risk of carrier loss. A higher development potential poses also problems of faster deterioration of the latent image bearing member, e.g. photoconductors.

Carrier loss must be avoided when using an electrostatographic system to reproduce faitfully both fine lines (i.e. have high resolution) and uniform density areas with fairly low differences in density (i.e. having a good gray scale balance). When carrier particles are deposited together with toner particles on the latent image to form a powder image that will be transferred on the support for the final image, they increase the distance between the latent image bearing member and the final support and hampers the adequate transfer of the powder image to the final support. Moreover around the carrier particles no transfer at all takes places leaving white spots in the final image. On the other hand, carrier particles being mostly black, in those places where carrier particles are accidentally transferred along with toner particles, black spots are present in the final image. These blemishes are intorerable when reproducing high quality, half tone, full colour images.

Although all disclosures concerning the matching of carrier and toner particles to achieve high electrostatographic quality do provide improvements for developers, there is still an appreciable need for further improvement in the production of two component developers for electrostatographic application where "offset-quality" is desired in the final copy. By "offset-quality" is meant a print quality that is indistinguishable from the quality that can be attained by classical offset printing techniques. Especially the need to have a developer, with which it is possible to combine high resolution, highly uniform optical density, full gray scale control and low defects such as low carrier loss, is still present. A "fine-haired" magnetic brush with low carrier loss with an extended life cycle for both photosensitive member and developer, is still not totally attainable with the cited teachings.

OBJECT AND SUMMARY OF THE INVENTION.

It is an object of the present invention to provide an electrostatic dry developer that makes it possible, in an electrostatographic process, to achieve images, both pictures and text, with "offset-quality".

It is more specifically an object of the present invention to provide a electrostatographic dry developer, comprising toner and carrier particles with which it is possible to combine high resolution, highly uniform optical density, full gray scale control, using a "fine-haired" magnetic brush, exhibiting low carrier loss with an extended life cycle for both photosensitive member and developer.

It is a further object of the present invention to provide a dry two component electrostatographic developer with which it is possible to obtain high quality images with low defect rate, high optical maximal density and low background density using moderate electrical fields.

It is still a further object of the present invention to provide a dry two component electrostatographic developer with no appreciable edge enhancement effect in the final images.

Further objects and advantages of the present invention will become clear from the description hereinafter.

In accordance with the present invention an electrostatographic develeveloper composition is provided, which composition comprises carrier particles and toner particles with a toner particle size distribution having a volume average particle size (T) such that 4 mμ≦T≦12 μm and an average charge (absolute value) pro diameter in femtocoulomb/10 μm ($C_T$) after triboelectric contact with said carrier particles such that 1 fC/10 μm≦$C_T$≦10 fC/10 μm characterised in that (i) said carrier particles have a saturation magnetization value, $M_{sat}$, expressed in Tesla (T) such that $M_{sat}$≧0.3 T (ii) said carrier particles have a volume average particle size ($C_{avg}$) such that 30 μm≦$C_{avg}$≦60 μm (iii) said volume based particle size distribution of said carrier particles has at least 90% of the particles having a particle diameter C such that 0.5 $C_{avg}$≦C≦2$C_{avg}$ (iv) said volume based particles size distribution of said carrier particles comprises less than b % particles smaller than 25 μm wherein $b=0.35\times(M_{sat})^2\times P_{max}$ with $M_{sat}$: saturation magnetization value, $M_{sat}$, expressed in T $P_{max}$: the maximal field strength of the magnetic developing pole expressed in kA/m (v) said carrier particles comprise a core particle coated with a resin coating in an amount (RC) such that 0.2% w/w≦RC≦2% w/w

DETAILED DESCRIPTION OF THE INVENTION

Figure 1:
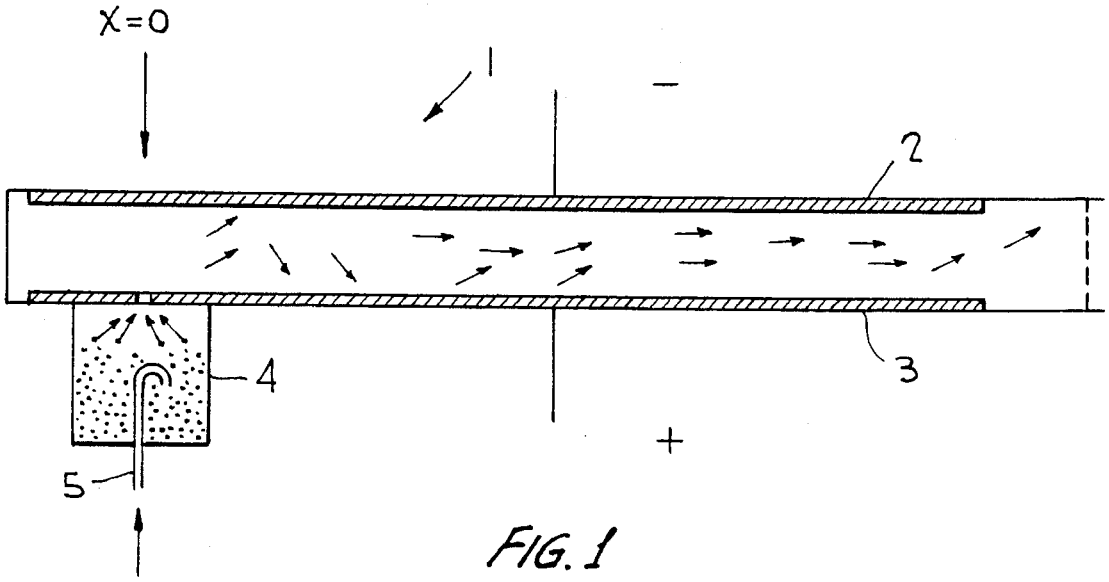
FIG. 1 represents a schematic cross-sectional drawing of an apparatus used in the determination of the standard deviation(s) and median q/d (charge/diameter) of a toner.

In previous teachings on the matching of the properties of the toner and carrier particles, there was no detailed teaching on the structure of the "magnetic brush". A "magnetic brush" is composed of particulate material, carrier particles with toner particles adhered thereon, that build up the "hairs" of the brush. Said "hairs" transfer toner to the latent image through contact between the "hairs" and a latent image bearing member. By the contact the "hairs" of the magnetic brush and the already deposited image can give, it is possible that the image becomes scratched. Such scratches deteriorate greatly the image quality, especially in uniform density areas, where said scraches are readily visible by the naked eye.

It is thus of great importance to create a "soft" magnetic brush on the magnetic rollers. This means that a brush with "fine " hairs is necessary.

It was found that, in order to build up a "fine haired, soft" magnetic brush, the carrier particles, used for producing the electrostatographic two component developer according to the present invention should have a volume average particle size ($C_{avg}$) such that 30 μm≦$C_{avg}$≦60 μm, a procedure for measuring the particle size distribution of the carrier particles is given in ASTM B 214-56. It has been found however that this precaution was not enough to provide a developer that could produce "offset-quality" images. It was moreover necessary that the size distribution of the carrier particles was narrow. The size distribution on volume basis should contain at least 90% of the particles having a particle diameter C such that 0.5 $C_{avg}$≦C≦2$C_{avg}$. It has been found that, even with such an arrow particle size distribution, it is of utmost importance to limit the amount (based on volume) of smaller carrier particles to limit carrier loss. Carrier loss is experienced when the "hairs" of the magnetic brush are broken. Apparently the breaking or cleavage of the hairs of the magnetic brush is increased by the presence of extremely fine carrier particles. The allowable amount of fine carrier particles depends on the saturation magnetisation ($M_{sat}$) of the carrier particles. The saturation magnetization ($M_{sat}$) is measured in a Princeton Applied Research Model 155 Vibrating Sample Magnetometer, available from Princeton Applied Research Co., Princeton, N.J. The greater $M_{sat}$ (in T), the greater the allowable amount of fine carrier particles, since due to the higher magnetic interaction, the carrier particles tend to adhere more strongly to the magnetic brush. Also when the maximal strength of the development pole ($P_{max}$in kA/m) on the magnetic roller is high, the adherance of the carrier particles to the magnetic brush is higher and the cleavage of the "hairs" diminished.

It was found that the amount b % (based on volume), of carrier particles with a size lower than 25 μm that percentage wise can be allowed in the carrier distribution fulfils the equation:

$$b\%=0.35\times(M_{sat})^2\times P_{max}$$

The basic composition of carrier particles for use accordance with the present invention, are described e.g. in United Kingdom Patent Specification 1,438,110. For magnetic brush development the carrier particles may be on the basis of ferromagnetic material e.g. steel, nickel, iron beads, ferrites, magnetites, composite materials comprising a resin binder and magnetic partilcles and the like or mixtures thereof. It is also possible to use, for the carrier according to the present invention, mixtures of any of the known carrier materials to make up the developer in combination with toner particles. Typical examples of composite carrier materials and procedures to produce such carrier materials are disclosed in e.g. EP 289663.

Since the toner particles are triboelectrically charged through triboelectric contact between the toner particles and the carrier particles the surface of the carrier particles may be changed so as to give the toner particles a triboelectrically generated charge in the desired amount and with the desired polarity.

For the carrier particles, according to the present invention, it has proven essential to coat the surface of the carrier particles with a resin in amounts between 0.2% and 2% w/w of resin with respect to the carrier. Said limits are dictated by the need to insulate the carrier particles, to minimize carrier ejection and to keep enough conductibility to prevent edge enhancement to occur.

The resin used for coating the carrier particles, according to the present invention, should have good insulating and film forming properties and have a good abrasion resistance. In a prefered embodiment of the present invention, the resin is preferably an acrylic resin and/or methacrylic homo- or copolymer. Most preferably the carrier particles, according to the present invention, are coated with a Si-containing resin.

When using a composite carrier particles it is beneficial to cross-link (at least partilally) the resin forming, together with magnetic particles, the core of the carrier particle before the application of the coating.

The toner particles used in accordance with the present invention should have an approximately normal volume based particle size distribution, with a volume average grain size, T, such that 4 μm≦T≦12 μm, more preferably 6 μm≦T≦9 μm. The coefficient of variability (standard deviation/average), V, of the particle size distribution of the toner particles and which is a measure of the narrowness of a normal distribution independent of the value of the average, should be equal or lower than 0.33.

The toner particles used in accordance with the present invention may comprise any conventional resin binder. The binder resins used for producing toner particles according to the present invention may be addition polymers e.g. polystyrene or homologues, styrene/acrylic copolymers, styrene/methacrylate copolymers, styrene/acrylate/acrylonitile copolymers or mixtures thereof. Addition polymers suitable for the use as a binder resin in the production of toner particles according to the present invention are disclosed e.g. in BE 61.855/70, DE 2,352,604, DE 2,506,086, U.S. Pat. No. 3,740,334.

Also polycondensation polymers may be used in the production of toner particles according to the present invention. Polyesters prepared by reacting organic carboxylic acids (di or tricarboxylic acids) with polyols (di- or triol) are the most prefered polycondensation polymers. The carboxylic acid may be e.g. maleic acid, fumaric acid, phthalic acid, isophthalic acid, terephthalic acid, trimellitic acid, etc or mixtures thereof. The polyolcomponent may be ethyleneglycol, diethylene glycol, polyethylene glycol, a hisphenol such as 2,2-bis(4-hydroxyphenyl)propane called "bisphenol A" or an alkoxylated bisphenol, a trihydroxy alcohol, etc or mixtures thereof. Polyesters, suitable for use in the preparation of toner particles according to the present invention are disclosed in e.g. U.S. Pat. Nos. 3,590,000, 3,681,106, 4,525,445, 4,657,837, 5,153,301.

It is also possible to use a blend of addition polymers and polycondensation polymers in the preparation of toner particles according to the present invention as disclosed e.g. in U.S. Pat. No. 4,271,249.

The amount of triboelectric charge (expressed as charge/particle diameter, Q/d) that is induced onto the toner particles by triboelectric friction between toner and carrier particles is controlled by adjusting carefully either the triboelectric value of the coating of the carrier particles and/or of the toner resin either by adding selected charge generating agents or by carefully controling the effect of the resinous matrix within the toner particles on the conductivity. This can be achieved by introducing e.g. onium compounds, betaines, ionically conductive polymers etc. The use of such compounds is disclosed in non published PCT applications PCT/EP94/01310 and PCT/EP94/01321 both filed on Apr. 25, 1994.

The charge per particle diameter (Q/d) of the toner particles, according to the present invention, is limited to an average value, $C_T$ in femtoCoulomb (fC)/10 μm, such that 1 fC/10 μm$\leqq C_T \leqq$10 fC/10 μm, Preferably 2 fC/10 μm$\leqq C_T \leqq$8 fC/10 μm.

The problem is that toners with low charge/diameter ratio normally will have a broad distribution spectrum of charge/diameter ratio with regard to the individual toner particles in the developer composition. A broad distribution spectrum of said ratio is characterized by (1) the presence of a relatively large amount of particles that have a charge too low for providing a sufficiently strong coulomb attraction and (2) the presence of wrong charge sign toner particles that have a charge sign opposite to the major part of the bulk of the toner particles. The development with such kind of developer results in an undesirable image-background fog.

The addition of compounds, described in non published PCT applications PCT/EP94/01310 and PCT/EP94/01321 both filed on Apr. 25, 1994, into the resinous matrix of the toner particles makes it also possible to control the spread of the distribution of Q/d over the toner particles. In a preferred embodiment of the present invention the distribution of Q/d over the toner particles has a variability coefficient v$\leqq$0.33.

The measurement of the average Q/d of the toner particles can be done by means of a charge spectrograph apparatus operating as schematically shown in FIG. 1.

The apparatus involved is sold by Dr. R. Epping PES-Laboratorium D-8056 Neufahrn, Germany under the name "q-meter". The q-meter is used to measure the distribution of the toner particle charge (q in fC) with respect to a measured toner diameter (d in 10 μm). The measurement result is expressed as percentage particle frequency (in ordinate) of same q/d ratio on q/d ratio expressed as fC/10 μm (in abscissa).

Referring to said FIG. 1 the measurement is based on the different electrostatic deflection according to their q/d ratio of triboelectrically charged toner particles making part of a bunch of toner particles carried by a laminar air flow in a long narrow tube 1 at a mean speed $v_m$ while passing through an electrical field E maintained perpendicular to the axis of said tube 1 by a registration electrode plate 2 and plate electrode 3 of opposite charge sign with respect to the registration electrode. Said electrodes are forming a condensor with plate distance y (5 cm). A bunch of triboelectrically charged toner particles is injected by air-pulse into said tube 1 from a little pot 4 containing an air injection inlet 5 and a certain amount of electrostatographic powder developer to be tested. The developer is composed of magnetic carrier particles mixed with toner particles. The carrier particles are retained in the pot 4 by means of a magnetic field stemming from an electromagnet situated at the bottom of said pot.

In said test arrangement all toner particles with constant ratio q/d deposit in said tube according to their charge sign on the electrode of opposite charge sign as a "toner spectrum line at a point "x" in the tube, so that q/d=f (x).

The registered toner deposit at x=0 (obtained by deposition in the absence of laminar flow) is used for controlling the equipment and for easy analysis of the records obtained.

At a plate distance of y=50 mm of said condensor for producing the electric field E the following equation may be used to determine the q/d value of toner particles deposited at different points "x".

$$qE=3\pi\eta v_m dy/x$$

where :

q is in fC, E is the electric field in kV/y, d is in 10 μm units, π is 3.14, η is the air viscosity, and x and y are in nun.

When the air flow AF is expressed in litre/min the q/d value is calculated by the following equation :

$$q/d(fC/10\ \mu m)=a36AF(\text{ltr/min})/V(kV)x(\text{mm})$$

where:

V is the voltage between the electrodes, and "a" is a correction factor for small broadness of the registration electrode. By means of a photomicroscope (microscope coupled to CCD-video camera) operating with an image analyzer the quantity of deposited toner particles and the percentage of toner deposited at same place is determined.

For more detailed information how to operate said "q-meter" reference is made to its operation manual of March 1988.

The polarity of the charge of toner particles according to the present invention is controlled by chosing the resin, making up the toner particles, taking in account the position of the resin, used to coat the carrier particles, in the triboelectric series as described in the article "Physics of Electrophotography" of Donald M. Burland and Lawrence B. Schein in "Physics Today / May 1986, p. 51. In order to modify or improve further the triboelectric chargeability in either negative or positive direction the toner particles may contain (a) charge control agent(s). For example, in published German patent application (DE-OS) 3,022,333 charge control agents for yielding negatively chargeable toners are described. In DE-OS 2,362,410 and U.S. Pat. Nos. 4,263,389 and 4,264,702 charge control agents for positive chargeability are described. Very useful charge controlling agents for providing a net positive charge to the toner particles are described in U.S. Pat. No. 4,525,445, more particularly BONTRON NO4 (trade name of Oriental Chemical Industries - Japan) being a nigrosine dye base neutralized with acid to form a nigrosine salt, which is used e.g. in an amount up to 5% by weight with respect to the toner particle composition. A charge control agent suitable for use in colourless or coloured toner particles is zinc benzoate and reference therefor is made to published European patent Application 0 463 876 decribing zinc benzoate compounds as charge controlling agents. Such charge controlling agent may be present in an amount up to 5% by weight with respect to the toner particle composition. When carrier particles coated with a Si-containing resin are used, as in a preferred embodiment of the present invention, it is preferred to combine said carrier particles with toner particles comprising a polyester as resinous matrix to give negatively charged toner particles.

The toner particles according to the present invention may be as well colour toners (yellow, magenta and cyan) as black toners.

It is possible to combine (an) organic colouring pigment(s) (e.g. a cyan dye) with an inorganic black pigment to ensure that the black toner will yield a neutral black colour. Preferably the inorganic black pigment, used together with an organic colouring pigment to have a neutral black, is carbon black. Examples of carbon black are lamp black, channel black and furnace black e.g. SPEZIALSCHWARZ IV (trade name of Degussa Frankfurt/M - Germany) and VULCAN XC 72 and CABOT REGAL 400 (trade names of Cabot Corp. High Street 125, Boston, U.S.A.).

The colour toners (yellow, magenta and cyan) may contain organic colouring pigments of the group of phthalocyanine dyes, quinacridone dyes, triaryl methane dyes, sulphur dyes, acridine dyes, azo dyes and fluoresceine dyes. A review of these colouring substances can be found in "Organic Chemistry" by Paul Karrer, Elsevier Publishing Company, Inc. New York, U.S.A (1950).

Likewise may be used the colouring substances described in the following published European patent applications (EP-A) 0 384 040, 0 393 252, 0 400 706, 0 384 990, and 0 394 563.

It is possible, when necessary for fine tuning the hue, chroma and lightness of the colour of the toner particles, to add to the toner composition, according to the present invention, mixtures of said organic colouring pigments. It is also possible to use, in the toner particles according to the present invention, soluble dyes, be it alone or in combination with organic colouring pigments.

Examples of particularly suited organic colouring substances are listed according to their colour yellow, magenta or cyan and are identified by name and Colour Index number (C.I. number)in the following Table 1 which also refers to the manufacturer.

TABLE

| | Colour Index 1 and 2 | | Manufacturer |
|---|---|---|---|
| Yellow dye | | | |
| Permanent Yellow GR | PY 13 | 21100 | Hoechst AG |
| Permanent Yellow GG02 | PY 17 | 21105 | Hoechst AG |
| Novoperm Yellow FGL | PY 97 | 11767 | Hoechst AG |
| Permanent Yellow GGR | PY 106 | | Hoechst AG |
| Permanent Yellow GRY80 | PY 174 | | Hoechst AG |
| Sicoechtgelb D1155 | PY 185 | | BASF |
| Sicoechtgelb D1350DD | PY 13 | 21100 | BASF |
| Sicoechtgelb D1351 | PY 13 | 21100 | BASF |
| Sicoechtgelb D1355DD | PY 13 | 21100 | BASF |
| Magenta dye | | | |
| Permanent Rubin LGB | PR57:1 | 15850:1 | Hoechst AG |
| Hostaperm Pink E | PR122 | 73915 | Hoechst AG |
| Permanent Rubin E02 | PR122 | 73915 | Hoechst AG |
| Permanent Carmijn FBB02 | PR146 | 12433 | Hoechst AG |
| Lithol Rubin D4560 | PR57:1 | 15850:1 | BASF |
| Lithol Rubin D4580 | PR57:1 | 15850:1 | BASF |
| Lithol Rubin D4650 | PR57:1 | 15850:1 | BASF |
| Fanal Rosa D4830 | PR81 | 45160:1 | BASF |
| Cyan dye | | | |
| Hostaperm Blue B26B | PB15:3 | 74160 1 | Hoechst AG |
| Heliogen Blau D7070DD | PB15:3 | 74160 | BASF |
| Heliogen Blau D7072DD | PB15:3 | 74160 | BASF |
| Heliogen Blau D7084DD | PB15:3 | 74160 | BASF |
| Heliogen Blau D7086DD | PB15:3 | 74160 | BASF |

In order to obtain toner particles with sufficient optical density in the spectral absorption region of the colourant, the colourant is preferably present therein in an amount of at least 0.5% by weight with respect to the total toner composition, more preferably in an amount of 1 to 10% by weight.

The toner particles may also comprise inorganic filler materials. By inorganic filler material is, according to the present invention to be understood any filler being composed of more than 90% of pure inorganic material. Small organic alterations, such as e.g. those to inhibit moisture degradation of the filler, can be incorporated, as long as the surface activity of the inorganic filler is not completely altered by said small organic alteration.

The use of spherical, inorganic filler particles has proved to offer advantages over non spherical particles.

Advantageously spherical fumed inorganics of the metal oxide class, selected from the group consisting of silica ($SiO_2$) and alumina ($Al_2O_3$) or mixed oxides thereof are selected. The fumed metal oxide particles have a smooth, substantially spherical surface. Their specific surface area is preferably in the range of 20 to 400 $m^2$ /g, more preferably in the range of 50 to 200 $m^2$ /g. The specific surface area (BET surface) can be measured by a method described by Nelsen and Eggertsen in "Determination of Surface Area Adsorption measurements by continuous Flow Method", Analytical Chemistry, Vol. 30, No. 9 (1958) p. 1387–1390.

It is possible to use either hydrophobic or hydrophilic inorganic particles.

In preferred embodiments the proportions for fumed metal oxides such as silica ($SiO_2$) and alumina ($Al_2O_3$) incorporated in the particle composition of the toner particles are in the range of 3 to 30% by weight.

The toner powder particles according to the present invention may be prepared by mixing the above defined binder resin(s) and ingredients (i.e. organic colouring substance, inorganic filler, etc) in the melt phase, e.g. using a kneader. The kneaded mass has preferably a temperature in the range of 90° to 140° C., and more preferably in the range of 105° to 120° C. After cooling the solidified mass is crushed, e.g. in a hammer mill and the obtained coarse particles further broken e.g. by a jet mill to obtain sufficiently small particles from which a desired fraction can be separated by sieving, wind classification, cyclone separation or other classifying technique. The actually used toner particles have preferably an average diameter between 5 and 10 μm on volume, more preferably between 6 and 9 μm when measured with a COULTER COUNTER (registered trade mark) MULTIZISER particle size analyzer operating according to the principles of electrolyt displacement in narrow aperture and marketed by COULTER ELEC$_7$RONICS Corp. Northwell Drive, Luton, Bedfordshire, LC 33, UK. In said apparatus particles suspended in an electrolyte (e.g. aqueous sodium chloride) are forced through a small aperture, across which an electric current path has been established. The particles passing one-by-one each displace electrolyte in the aperture producing a pulse equal the displaced volume of electrolyte. Thus particle volume response is the basis for said measurement.

Suitable milling and air classification may be obtained when employing a combination apparatus such as the Alpine FliessbethGegenstrahlmuhle (A.F.G.) type 100 as milling means and the Alpine Turboplex Windsichter (A.T.P.) type 50 G.C as air classification means, available from Alpine Process Technology, Ltd., Rivington Road, Whitehouse, Industrial Estate, Runcorn, Cheshire, UK. Another useful apparatus for said purpose is the Alpine Multiplex Zick-Zack Sichter also available from the last mentioned company.

The toner particles according to the present invention may also be prepared by a "polymer suspension" process. In this process the resin is dissolved in a water immiscible solvent with low boiling point and the pigment and the inorganic filler are dispersed in that solution. The resulting solution/dispersion is dispersed in an aqueous medium that contains a stabilizer, the organic solvent is evaporated and and the resulting particles are dried. As suspension stabilizer it is possible to use e.g. silica particles, water soluble organic protective colloids (e.g. polyvinylalcohol), surface active agents, etc.

To enhance the flowability of the developer composition, according to the present invention, it is possible to mix toner particles, according to the present invention, with flow improving additives. These flow improving additives are preferably extremely finely divided inorganic or organic materials the primary (i.e. nonclustered) particle size of which is less than 50 nm. Widely used in this context are fumed inorganics of the metal oxide class, e.g. selected from the group consisting of silica ($SiO_2$), alumina ($Al_2O_3$), zirconium oxide and titanium dioxide or mixed oxides thereof which have a hydrophilic or hydrophobized surface.

The fumed metal oxide particles have a smooth, substantially spherical surface and are preferably coated with a hydrophobic layer, e.g. formed by alkylation or by treatment with organic fluorine compounds. Their specific surface area is preferably in the range of 40 to 400 $m^2$ /g.

In preferred embodiments the proportions for fumed metal oxides such as silica ($SiO_2$) and alumina ($Al_2O_3$) are admixed externally with the finished toner particles in the range of 0.1 to 10% by weight-with respect to the weight of the toner particles.

Fumed silica particles are commercially available under the tradenames AEROSIL and CAB-O-Sil being trade names of Degussa, Franfurt/M Germany and Cabot Corp. Oxides Division, Boston, Mass., U.S.A. respectively. For example, AEROSIL R972 (tradename) is used which is a fumed hydrophobic silica having a specific surface area of 110 $m^2$ /g. The specific surface area can be measured by a method described by Nelsen and Eggertsen in "Determination of Surface Area Adsorption measurements by continuous Flow Method", Analytical Chemistry, Vol. 30, No. 9 (1958) p. 1387–1390.

In addition to the fumed metal oxide, a metal soap e.g. zinc stearate, as described in the United Kingdom Patent Specification No. 1,379,252, wherein also reference is made to the use of fluor containing polymer particles of submicron size as flow improving agents, may be present in the developer composition comprising the toner particles according to the present invention.

Said toner particles and carrier particles are finally combined to give an high quality electrostatic developer. This combination is made by mixing said toner and carrier particles in a ratio (w/w) of 1.5/100 to 15/100, preferably in a ratio (w/w) of 3/100 to 10/100. Said developer can be used in any magnetic brush development system.

The present invention is further illustrated by the following example, without however limiting the present invention to said examples. In the examples all proportion are by weight, except when specifically mentioned.

TESTMETHODS

PARTICLES SIZE DISTRIBUTION CARRIER PARTICLES (TEST I)

The particle size distribution of the carrier particles is determined according to ASTM B 214–56.

DETERMINATION OF THE FINE FRACTION IN THE PARTICLES SIZE DISTRIBUTION OF THE CARRIER PARTICLES (TEST II)

An accurately known amount of approximately 10 g (A) of carrier particles is introduced in a cylindrical container sealed at both end with a fabric screen with meshes having a diameter of 25 μm. An air stream at a pressure of 6 $10^5$ P, and an expansion aperture of _ 1.9 mm diameter, giving 50 pulse of 2 seconds duration is passed trough the cylinder. After the 50th pulse, the amount, L, of lost carrier is determined (in g). The fraction of particles smaller than 25 μm is $$F(\%)=L/A\times 100$$

PARTICLE SIZE DISTRIBUTION TONER PARTICLES (TEST III)

The particles size distribution of the toner particles is measured with a COULTER COUNTER (registered trade mark) MULTIZISER particle size analyzer operating according to the principles of electrolyt displacement in narrow aperture and marketed by COULTER ELECTRONICS Corp. Northwell Drive, Luton, Bedfordshire, LC 33, UK. In said apparatus particles suspended in an electrolyte (e.g. aqueous sodium chloride) are forced through a small aperture, across which an electric current path has been established. The particles passing one-by-one each displace electrolyte in the aperture producing a pulse equal the displaced volume of electrolyte. Thus particle volume response is the basis for said measurement.

DEVELOPMENT (TEST IV)

The development was performed in a test engine wherein high density patches on an organic photoconductor operated at 12.5 cm/sec were developed. The developer roller operated at a tangential velocity 2.0 times higher than the tangential velocity of the photoconductor and in cocurrent mode. The magnetic field strength on the magnetic development pole is 56 kA/m. The amount of developer on the developing sleeve was controled by a doctor blade to be 80 mg/$cm^2$. The development gap was chosen to be either 650 μm or 500 μm. The development was operated in reversal mode. By properly setting the bias and cleaning potentials on the photoconductor for each developer the optimal conditions were used for testing the performance.

CARRIER LOSS (TEST V)

A test development (Test IV) was made at 400 V developing potential. The image was developed with a yellow toner and transferred to white paper and oven fused at 120° C. for 5 min. Since carrier loss gives rise to blakish spots in the yellow image, carrier loss can be inspected visually. It can also be quantified by the apparatus sold by Dr. R. Epping PES-Laboratorium D-8056 Neufahrn, Germany under the name "q-meter". The q-meter is used to measure the charge/diameter of the toner particles as already described, but in its image analysing mode it can be used to quantify carrier loss. The final image was scanned by the image analyser of the q-meter and the carrier loss was determined as number of blackish dots pro 20 $mm^2$.

DETERMINATION OF THE CHARGE OF THE TONER PARTICLES (TEST VI)

The charge of the toner particles in fC/10 μm is determined, as described earlier, in an apparatus sold by Dr. R. Epping PES-Laboratorium D-8056 Neufahrn, Germany under the name "q-meter".

| PREPARATION OF TONER | |
|---|---|
| Polyester (ATLAC T500)* | 96 parts |
| Yellow pigment (table 1) | 3.5 parts |
| Tetrabutylammoniumbromide | 0.5 parts |

*ATLAC is a registered trade name of Atlas Chemical Industries

Inc. Wilmington, Del. U.S.A.) and ATLAC T500 is a linear polyester of fumaric acid and propoxylated bisphenol A.

The ingredients were melt kneaded at 110° C. for 30 min, after cooling, crushing and milling toner particles with an volume average particle size of 8.0 μm and a coefficient of variability v=0.25 were obtained. 100 parts of these toner partiles were mixed with 0.5 parts of $SiO_2$ (AEROSIL R972 tradename of Degussa Frankfurt/M-Germany.

The thus obtained toner is termed hereinafter "the toner".

PREPARATION OF THE DEVELOPER 96 parts of carrier particles were mixed with 4 parts of the toner, described above. The components were mixeded for 10 minutes rotating, with a surface velocity of 20 cm/sec, 500 g of the developer in a cylindrical PE-bottle with diameter 7.5 cm and height of 12 cm. The developer was introduced in the described developing unit. -After 10 minutes of mixing a sample was drawn to measure the Q/d in fC/10 μm and the developer was used in a development sequence described in Test IV to produce images. This procedure is herinafter termed "procedure I".

EXAMPLES

COMPARATIVE (non-invention) EXAMPLE 1 (CE1)

A Cu—Zn ferrite based coated carrier was prepared by coating a Cu—Zn ferrite core with 1% of dimethylsilicone using a solution spraying technique in a fluidized bed and post curing the coating. The carrier showed a saturation magnetization ($M_{sat}$) of 0.41 T. The particle size distribution was characterized by:

$d_{v50\%}$=52.5 μm, $d_{v10\%}$=32 μm and $d_{v90\%}$=65 μm.

The amount of particles <25 μm (test II) was 4.9% w/w. A developer was prepared according to procedure I by adding 4% of the toner to the carrier particles. The toner had a charge of −3.7 fC/10 μm.

This developer was used in a development test (test IV) and the carrier loss determined according to test V.

The image quality in terms of resolution and high optical density were satisfactory, but a carrier loss of 800 particles was observed, resulting in an unacceptable contamination in the final image.

COMPARATIVE (non-invention) EXAMPLE 2 (CE2)

The developer of comparative example 1 was used, but in the development test (test IV) the developing gap was reduced from 650 μm to 500 μm. The carrier loss (test V) was reduced to 500 particles, but still the contamination of the final image was too high.

COMPARATIVE (non-invention) EXAMPLE 3 (CE3)

The developer of comparative example 1 was used, but in the development test (test IV) the developing gap was reduced from 650 μm to 500 μm and the magnetic development pole had a magnetic field of 70 kA/m instead of 56 kA/m. The carrier loss (test V) was 480 particles, again resulting in a quite high contamination in the final image.

COMPARATIVE (non-invention) EXAMPLE 4 (CE4)

The procedure of comparative example 1 was repeated, except for the coating. The Cu-Zn ferrite core was not coated with a resin. The particle size distribution was :

$d_{v50\%}$=52.5 μm, $d_{v10\%}$=37 μm and $d_{v90\%}$=66.5 μm.

The amount of particles <25 μm (test II) was 1.5% w/w. A developer was prepared according to procedure I by adding 4% of the toner to the carrier particles. The toner had a charge of −2.3 fc/10 μm.

The image quality in terms of resolution and high optical density was unacceptable and the carrier loss (test V) was 4330 particles, resulting in a severe, unacceptable contamination in the final image.

COMPARATIVE (non-invention) EXAMPLE 5 (CE5)

An insulating composite carrier was prepared by melt blending 20% of a thermoplastic polymer resin comprising a polycondensation product of propoxylated bisphenol A and fumaric acid with 80% of magnetite pigment particles with size <1 μm. After cooling, the mixture was crushed and classified, and the resulting particles were mechanofused to coat the particles with the polyester resin of their own composition. The composite carrier material had a size distribution:

$d_{v50\%}$=70 μm, $d_{v10\%}$=52.5 μm and $d_{v90\%}$=82.5 μm.

The amount of particles <25 μm (test II) was 0% w/w. The carrier showed a saturation magnetization ($M_{sat}$) of 0.28 T. A developer was prepared according to procedure I by adding 4% of the toner to the carrier particles. The toner had a charge of −2.2 fc/10 μm.

The image quality in terms of resolution and high optical density was fair and the carrier loss (test V) was 400 particles, resulting in a quite high contamination in the final image.

EXAMPLE 1 (E1)

A carrier as described in comparative (non-invention) example CE1 was prepared, but the fraction of carrier particles smaller than 25 μm was lowered to 0.9%. A developer was prepared according to procedure I by adding 4% of the toner to the carrier particles. The toner had a charge of −3.9 fC/10 μm.

This developer was used in a development test (test IV) and the carrier loss determined according to test V.

The image quality in terms of resolution and high optical density was excellent and the carrier loss (test II) was only 36 particles. The visual inspection of the final image did reveal almost no contamination of the image.

EXAMPLE 2 (E2)

A carrier with the same composition as described in comparative example 1 (CE1) was prepared, buth the particle size distribution was changed:

$d_{v50\%}$=44.5 μm, $d_{v10\%}$=30 μm and $d_{v90\%}$=60 μm.

The amount of particles <25 μm (test II) was 1.1% w/w. A developer was prepared according to procedure I by adding 4% of the toner to the carrier particles. The toner had a charge of −5.0 fc/10 μm.

The image quality in terms of resolution and high optical density was excellent and the carrier loss (test II) was only 55 particles. The visual inspection of the final image did reveal almost no contamination of the image.

EXAMPLE 3 (E3)

A carrier with the same composition as described in comparative example 1 (CE1) was prepared, buth the particle size distribution was slightly different:

$d_{v50\%}$=52.5 μm, $d_{v10\%}$=31 μm and $d_{v90\%}$=64 μm.

The amount of particles <25 μm (test II) was 2.3% w/w. A developer was prepared according to procedure I by adding 4% of the toner to the carrier particles. The toner had a charge of −4.8 fc/10 μm.

The image quality in terms of resolution and high optical density was excellent and a carrier loss (test II) was 130 particles with a development gap of 650 μm. Contamination did not interfere with the image quality of the final image.

EXAMPLE 4 (E4)

The developer of example 3 (E3) was used, but in the development test (test IV) the development gap was reduced to 500 μm. The carrier loss was 65 particles. The visual inspection of the final image did reveal almost no contamination of the image.

EXAMPLE 5 (E5)

A carrier with the same composition as described in comparative example 1 (CE1) was prepared, buth the particle size distribution was slightly different:

$d_{v50\%}$=54 μm, $d_{v10\%}$=37 μm and $d_{v90\%}$=65 μm.

The amount of particles <25 μm (test II) was 0.3% w/w. A developer was prepared according to procedure I by adding 4% of the toner to the carrier particles. The toner had a charge of −3.6 fc/10 μm.

The image quality in terms of resolution and high optical density was excellent and the carrier loss (test II) was only 38 particles with a development gap of 650 μm. The visual inspection of the final image did reveal almost no contamination of the image.

EXAMPLE 6 (E6)

The developer of example 5 (E5) was used, but in the development test (test IV) the development gap was reduced to 500 μm. The carrier loss was 30 particles and almost no contamination of the final image was observed.

EXAMPLE 7 (E7)

A pure magnetite based coated carrier was prepared by coating a magnetite core with 1% of a silicon resin using a solution spraying technique in a fluidized bed and post curing the coating. The carrier showed a saturation magnetization ($M_{sat}$) of 0.56 T. The particle size distribution was characterized by:

$d_{v50\%}$=41 μm, $d_{v10\%}$=26.5 μm and $d_{v90\%}$=56 μm.

The amount of particles <25 μm (test II) was 4.8% w/w. A developer was prepared according to procedure I by adding 4% of the toner to the carrier particles. The toner had a charge of −6.4 fc/10 μm.

This developer was used in a development test (test IV) and the carrier loss determined according to test V.

The image quality in terms of resolution and high optical density was excellent, a carrier loss (test V) of 100 particles was observed. Almost no contamination of the final image could be observed.

The results of carrier loss for comparative example 1 to 5 and examples 1 to 6 are summarized in table 2.

TABLE 2

| | 1 | 2 | 3 | 4 | 5 | 6 | 7 | 8 |
|---|---|---|---|---|---|---|---|---|
| CE1 | 52.5 | F | Y | 0.41 | 56.0 | 650 | 4.9 | 800 |
| CE2 | 52.5 | F | Y | 0.41 | 56.0 | 500 | 4.9 | 500 |
| CE3 | 52.5 | F | Y | 0.41 | 70.0 | 500 | 4.9 | 480 |
| CE4 | 52.5 | F | N | 0.41 | 56.0 | 650 | 1.5 | 4430 |
| CE5 | 70 | C | M | 0.28 | 56.0 | 650 | 0 | 400 |
| E1 | 52.5 | F | Y | 0.41 | 56.0 | 650 | 0.9 | 36 |
| E2 | 44.5 | F | Y | 0.41 | 56.0 | 650 | 1.1 | 55 |
| E3 | 52.5 | F | Y | 0.41 | 56.0 | 650 | 2.3 | 130 |
| E4 | 52.5 | F | Y | 0.41 | 56.0 | 500 | 2.3 | 65 |
| E5 | 54 | F | Y | 0.41 | 56.0 | 650 | 0.3 | 38 |
| E6 | 54 | F | Y | 0.41 | 56.0 | 500 | 0.3 | 30 |
| E7 | 41 | M | Y | 0.56 | 56.0 | 650 | 4.8 | 100 |

column 1: $d_{v50\%}$ of the carrier particle
column 2: Core:ferrite (F), magnetite (M) or composite (C)
column 3: Coating yes (Y) or no (N) or mechanofusing (M)
column 4: Saturation magnetization $M_{sat}$ in T
column 5: Maximal field of the developing pole $P_{max}$ in kA/m
column 6: Development gap in μm
column 7: Fraction of carrier particles <25 μm in % w/w
column 8: Carrier loss in particles/20 $mm^2$ (cfr Test V)

From table 2 it is clear that lowering of the amount of small carrier particles reduces the carrier loss, and that when the saturation magnetization of the carrier particles is higher, a higher fraction of small particles can be allowed, from comparative example CE5 it becomes clear that a saturation magnetization lower than 0.30 T is too low to prevent carrier loss, even if the fraction of small carrier particles is zero.

We claim:

1. An electrostatographic developer composition comprising carrier particles and toner particles with a toner particle size distribution having a volume average particle size (T) such that 4 μm≦T≦12 μm and an average charge (absolute value) pro diameter in femtocoulomb/10 μm ($C_T$) after triboelectric contact with said carrier particles such that 1 fC/10 μm≦$C_T$≦10 fC/10 μm characterised in that (i) said carrier particles have a saturation magnetization value, $M_{sat}$, expressed in Tesla (T) such that $M_{sat}$≧0.30 T (ii) said carrier particles have a volume average particle size ($C_{avg}$) such that 30 μm≦$C_{avg}$≦60 μm (iii) said volume based particle size distribution of said carrier particles has at least 90% of the particles having a particle diameter C such that 0.5 $C_{avg}$≦C≦2$C_{avg}$ (iv) said volume based particles size distribution of said carrier particles comprises less than b % particles smaller than 25 μm wherein b=0.35×$(M_{sat})^2$×P with $M_{sat}$: saturation magnetization value, $M_{sat}$, expressed in T P: the maximal field strength of the magnetic developing pole expressed in kA/m (v) said carrier particles comprise a core particle coated with a resin coating in an amount (RC) such that 0.2% w/w≦RC≦2% w/w.

2. An electrostatographic developer composition according to claim 1, wherein said resin coating is a non-fluor containing resin.

3. An electrostatographic developer composition according to claim 2, wherein said non-fluor containing resin is an acrylic resin.

4. An electrostatographic developer composition according to claim 1, wherein said non-fluor containing resin comprises Si 5. An electrostatographic developer composition according to claim 1, wherein said carrier particles have a saturation magnetization ($M_{sat}$) such that $M_{sat}$0.375 T.

6. An electrostatographic developer composition according to claim 1, wherein said volume average particle size (T) of said toner particles is such that 6 μm≦T≦9 μm.

7. An electrostatographic developer composition according to claim 1, wherein said particle size distribution of said toner particles show a coefficient of variability (standard deviation of the distribution/average particle size) v≦0.33.

8. An electrostatographic developer composition according to claim 1, wherein said toner particles get a charge (absolute value) pro particle diameter in femtocoulomb/10 μm ($C_T$) after triboelectric contact with said carrier particles such that 2 fc/10 μm≦$C_T$≦8 fc/10 μm.

9. An electrostatographic developer composition according to claim 1, wherein said toner particles are triboelectrically negatively charged by said carrier particles.

10. An electrostatographic developer composition according to claim 1, wherein said toner particles comprise a polyester as binder resin.

11. An electrostatographic developer composition according to claim 10, wherein said polyester is a linear polyester or a blend of polyesters.

12. An electrostatographic developer composition according to claim 1, wherein said toner particles comprises organic colouring substance(s) that are Yellow, Magenta, Cyan colouring substances or a mixture thereof and wherein the toner mass has a melt viscosity at 120° C. between 2500 and 15000 P.

13. A method of non-contact heat fixing electrostatically deposited dry toner particles after their deposition or transfer onto a substrate, the improvement comprising utilizing an electrostatographic developer composition comprising carrier particles and toner particles with a toner particle size distribution having a volume average particle size (T) such that 4 μm≦T≦12 μm and an average charge (absolute value) pro diameter in femtocoulomb/10 μm ($C_T$) after triboelectric contact with said carrier particles such that 1 fC/10 μm≦$C_T$≦10 fC/10 μm, wherein (i) said carrier particles have a saturation magnetization value, $M_{sat}$, expressed in Tesla (T) such that $M_{sat}$≧0.30 T (ii) said carrier particles have a volume average particle size ($C_{avg}$) such that 30 μm≦$C_{avg}$≦60 μm (iii) said volume based particle size distribution of said carrier particles has at least 90% of the particles having a particle diameter C such that 0.5 $C_{avg}$≦C≦2$C_{avg}$ (iv) said volume based particles size distribution of said carrier particles comprises less than b % particles smaller than 25 μm wherein b=0.35×$(M_{sat})^2$×P with $M_{sat}$: saturation magnetization value, Meat, expressed in T P: the maximal field strength of the magnetic developing pole expressed in kA/m (v) said carrier particles comprise a core particle coated with a resin coating in an amount (RC) such that 0.2% w/w≦RC≦2% w/w.

* * * * *